United States Patent [19]

Campagnuolo et al.

[11] Patent Number: 4,581,999

[45] Date of Patent: Apr. 15, 1986

[54] SUPERSONIC HIGH ALTITUDE FLIGHT SIMULATOR FOR AIR DRIVEN GENERATORS

[75] Inventors: Carl J. Campagnuolo, Potomac, Md.; Henry C. Lee, Menlo Park, Calif.

[73] Assignee: The United States of America as represented by the Secretary of the Army, Washington, D.C.

[21] Appl. No.: 599,379

[22] Filed: Apr. 12, 1984

[51] Int. Cl.[4] ..... F42C 21/00

[52] U.S. Cl. ..... 102/293; 73/167

[58] Field of Search ..... 102/207, 293; 73/167

[56] References Cited

U.S. PATENT DOCUMENTS

| | | | |
|---|---|---|---|
| 3,772,541 | 11/1973 | Campagnuolo et al. | 102/207 |
| 4,033,185 | 7/1977 | McNally et al. | 73/167 |
| 4,083,238 | 4/1978 | Dick | 73/167 |
| 4,193,297 | 3/1980 | Plotkin | 73/167 |
| 4,362,106 | 12/1982 | Campagnuolo et al. | 102/207 |
| 4,503,774 | 3/1985 | Campagnuolo | 102/207 |

*Primary Examiner*—Charles T. Jordan

*Attorney, Agent, or Firm*—Saul Elbaum; Thomas E. McDonald; Anthony T. Lane

[57] ABSTRACT

Apparatus to simulate supersonic high altitude flight for air driven electrical generators. First and second air-tight chambers are provided, as are means for evacuating the chambers to a preselected pressure. The air driven generator has both air inlet means and air outlet means. The air inlet means of the air driven generator is in fluid communication with the second air-tight chamber, and the air outlet means of the air driven generator is in fluid communication with the first air-tight chamber. Adjustable orifice means are provided. Valve controlled air inlet means for allowing air to enter the second air-tight chamber through the adjustable orifice means are also provided.

3 Claims, 2 Drawing Figures

SUPERSONIC HIGH ALTITUDE FLIGHT SIMULATOR FOR AIR DRIVEN GENERATORS

RIGHTS OF THE GOVERNMENT

The invention described herein may be manufactured and used by or for the United States Government for Government purposes without payment to us of any royalty thereon.

BACKGROUND OF THE INVENTION

Air driven electrical generators, when used aboard a projectile or a rocket, can experience flight altitude of 65,000 feet or higher. At these extreme high altitudes, the amount of pneumatic energy or mass flow is at a premium. This is due to the reduction of the density of air at such altitudes. Since the amount of electrical energy generated is a function of the mass flow that is available to the generator during flight, it is essential for the generator to operate at its designed efficiency during high altitude flight.

The efficiency of conversion of pneumatic energy to electrical energy has been found to depend largely on the geometrical parameters of the nozzle-resonator configuration. Ideally, to optimize the generator parameters during high altitude flight, a design study is performed in wind tunnel tests or flight tests. Such tests, however, are costly and time consuming.

One type of air driven generator is described in U.S. Pat. No. 3,772,541, issued on Nov. 13, 1973, to Campagnuolo et al. In this device air is caused to enter a nozzle in which a cylindrical plug is centrally located to form an annular orifice. The air discharging from the annular orifice impinges directly on the edge of a resonating cavity producing a multiple frequency edgetone. The column of air in the resonating cavity is thereby caused to vibrate at a frequency determined by the depth of the cavity. The changes in pressure within the resonating cavity cause a diaphragm forming an end of the cavity to pulsate inwardly and outwardly. A rod is attached to the diaphragm, and this rod transmits the vibrations of the diaphragm to a metallic reed which will then oscillate between a pair of magnetic pole pieces. The oscillations of the reed will induce an electromotive force into a coil. The electromotive force induced in the coil may be made available to provide energy to operate an external electrical circuit.

SUMMARY OF THE INVENTION

The present invention is an apparatus to simulate supersonic high altitude flight for air driven electrical generators. It does this by simulating the high altitude flight conditions by providing and exposing the generator to the same pressures it experiences in real flight at the air inlet of the ogive and at the ogive exhaust ports.

The invention provides first and second air-tight chambers. Means are provided for evacuating the first and second air-tight chambers to a preselected pressure. The air driven device has both air inlet means and air outlet means. The air inlet means of the air driven device is in fluid communication with the second air tight chamber. The air outlet means of the air driven device is in fluid communication with the first air-tight chamber. The first air-tight chamber is in fluid communication with the second air tight chamber by means of the air driven device. Adjustable orifice means are provided. Valve controlled air inlet means for allowing air to enter the second air-tight chamber through the adjustable orifice means are also provided in the present invention.

The air driven device comprises a projectile or rocket ogive with an air driven electrical generator mounted inside of it. The adjustable orifice means of the present invention forms the union between the second air-tight chamber and the valve controlled air inlet means.

OBJECT OF THE INVENTION

It is the object of this invention to provide a simple and accurate laboratory device that is capable of simulating the high altitude flight conditions experienced by the generator during projectile flight.

DESCRIPTION OF THE PREFERRED EMBODIMENT

Figure 1:
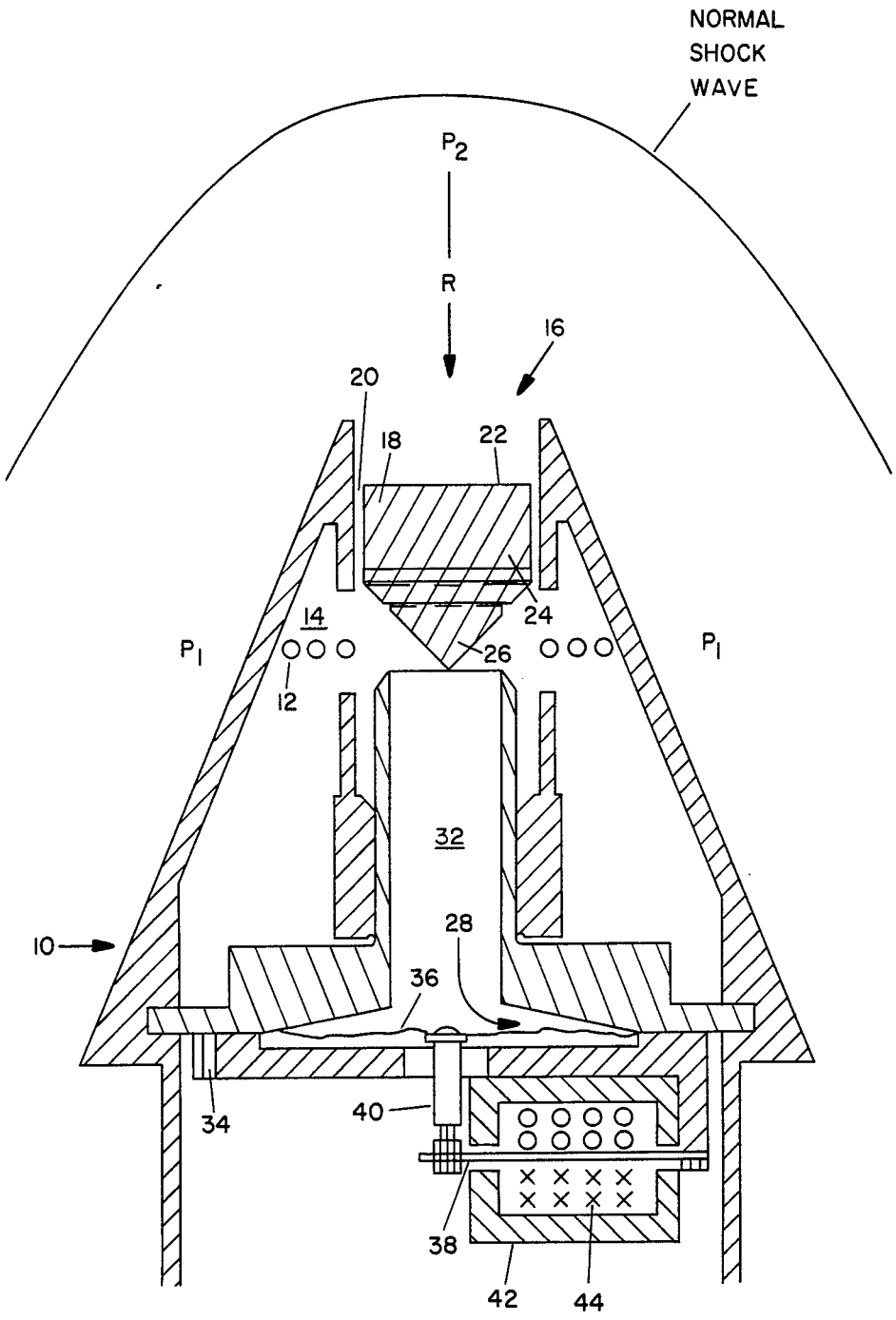
FIG. 1 is a cross sectional view of a projectile ogive containing a typical air driven electrical generator. Also shown is the normal shock wave produced by the projectile as it travels through the atmosphere at supersonic speeds.

When an air driven generator of the type described in U.S. Pat. No. 3,772,541, referred to above, and depicted in FIG. 1, is positioned in a projectile or rocket ogive 10 to power the vehicle electronics, such as a fuze, ram air enters through air inlet 16 at the nose of the ogive. The amount of ram air mass flow entering the generator determines the amount of electrical energy generated. The ram air mass flow is a function of the flight trajectory conditions. Specifically, it is a function of flight altitude and velocity (or Mach number).

FIG. 1 shows the pressures around ogive 10 during flight. The generator, inside the projectile ogive 10, is exposed to a total pressure at the ogive air inlet 16 equal to $P_2$. Pressure $P_2$ is determined by the flight Mach number and altitude expressed by the equation:

$$P_2 = \frac{\left[\frac{k+1}{(2)} M^2\right]^{\frac{k}{k+1}} P_1}{\left[\left(\frac{2k}{k+1}\right) M^2 - \left(\frac{k-1}{k+1}\right)\right]^{\frac{1}{k-1}}} \quad (1)$$

where:

$P_1$ = free stream static pressure at a given flight altitude;

M = projectile velocity expressed in terms of the local Mach number; and

K = 1.4 (ratio of specific heat capacities for air).

At the air outlets 12 of the ogive, the generator experiences a static pressure that approximately equals the free stream static pressure $P_1$, which is a function of altitude and can be found in standard atmospheric tables. For a given flight Mach number and altitude, the corresponding pressures of $P_2$ and $P_1$ determine the amount of ram air mass flow that enters the generator, and thus the amount of electrical energy generated.

As shown in FIG. 1, as the projectile travels through the atmosphere at supersonic speeds, it sets up a normal shock wave in front of it. The air pressure just in front of the projectile and entering air inlet 16 is represented by $P_2$. Projectile ogive 10 contains an air driven electric generator. Air outlet holes 12 and ventilating slots 14 for excess air are provided in ogive 10. Air inlet tube 16 allows ram air, designated by arrow R, to enter the ogive. Mounted inside of air inlet tube 16 is a cylindrical nozzle-centerbody 18 having a diameter smaller than the diameter of the air inlet tube, and forming an annular orifice 20. Nozzle-centerbody 18 has a round flat face 22 facing the incoming ram air, a solid cylindrical segment 24, and a cone segment 26 facing resonant cavity 28. An annular column of air emerges from annular orifice 20, and is directed into resonant cavity 28 through air channel 32. The air entering resonant cavity 28 causes acoustical vibrations therein. Air entering resonant cavity 28 is vented therefrom by means of vents 34 provided around the periphery of diaphragm 36. Vents 34 communicate with resonant cavity 28 by means not shown.

The acoustical vibrations set up in resonant cavity 28 cause diaphragm 36 to vibrate. Diaphragm 36 forms one end of resonant cavity 28. The motion of diaphragm 36 is transmitted to reed 38 by means of post 40 which is connected to diaphragm 36. Reed 38 oscillates within the magnetic field set up by permanent magnet 42 which induces an electric current in coil 44. This current is used to power the projectile electronics.

Figure 2:
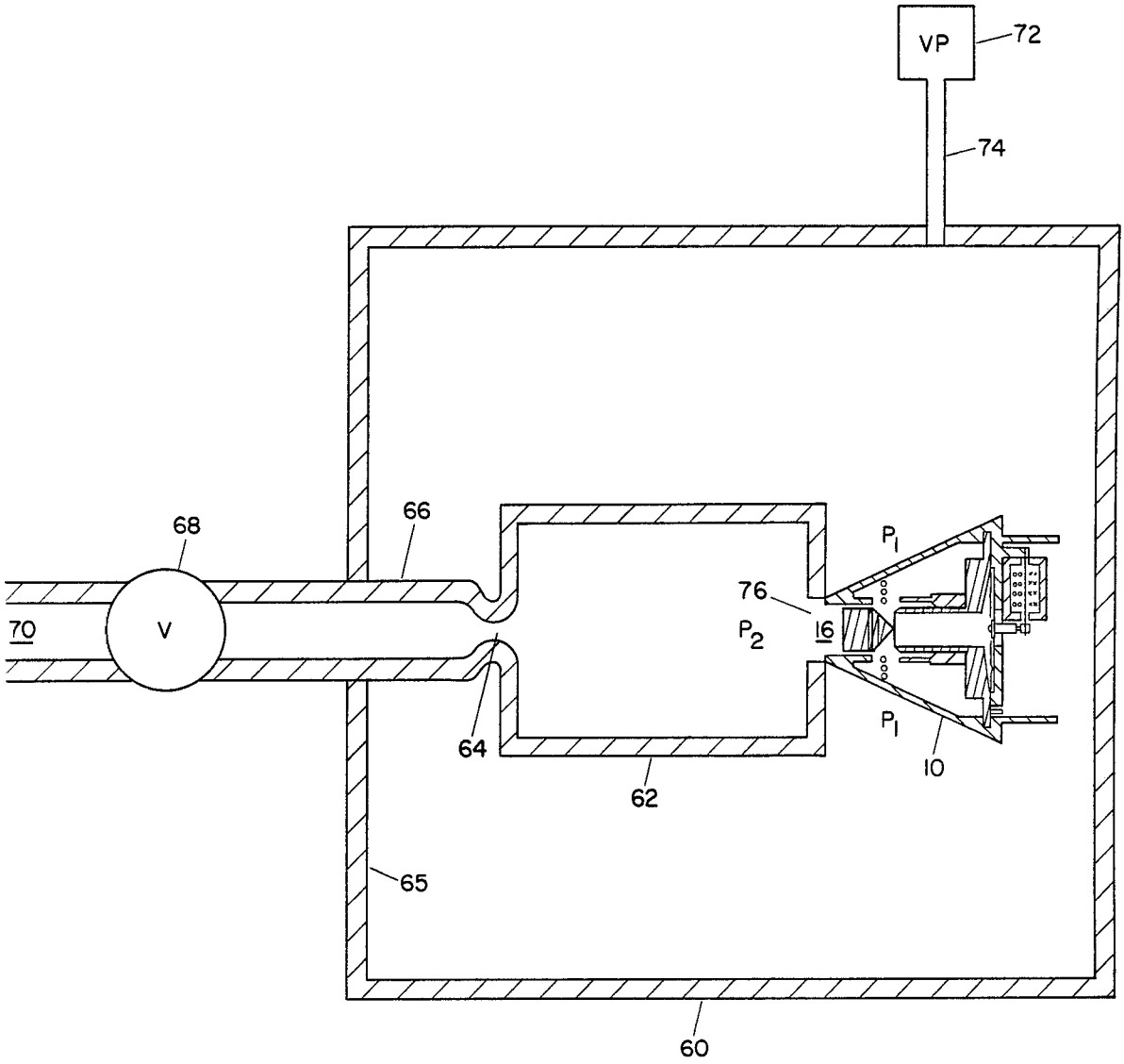
FIG. 2 is a cross sectional view of the present invention. The cross sectional view of the projectile ogive of FIG. 1 is also contained in FIG. 2.

FIG. 2 shows the preferred embodiment of the invention. The projectile ogive 10 of FIG. 1 is mounted to the second air-tight chamber 62 at opening 76. Second air-tight chamber 62 is in fluid communication with the first air-tight chamber 60 by means of projectile ogive 10. Vacuum pump 72, which is used to evacuate chambers 60 and 62 to a preselected pressure, communicates with chamber 60 by means of pipe 74. Air inlet tube 66 is connected to chamber 62 by means of adjustable orifice 64. Adjustable orifice 64 is adjustable by means not shown. Air inlet tube 66 passes through wall 65 of chamber 60, and is controlled by valve 68. End 70 of air inlet tube 66 is open to the ambient atmosphere.

The function of first air-tight chamber 60, in conjunction with vacuum pump 72 is to pump down the pressure inside the chamber to the desired pressure value at the air outlets 12 of ogive 10. This pressure is the free stream static pressure $P_1$ at a given altitude. The function of adjustable orifice 64 is to regulate the air entering from the ambient atmosphere condition outside the first air tight chamber 60, into the second air-tight chamber 62 to the desired pressure $P_2$, as determined by equation (1). This steady state pressure is that which establishes a mass flow out of the second air-tight chamber to the generator to be tested which is exactly equal to the inlet mass flow.

The system will function as described only when a sonic condition exists across adjustable orifice 64, causing a choked mass flow condition, and for the required supersonic flight simulation, mass flow is also choked at the ogive air inlet 16.

The area of the adjustable orifice 64 is related to the area of the projectile ogive air inlet 16 by the following relationship:

$$\frac{P_2}{P_{amb}} = \frac{A_{orifice}}{A_{generator}} \quad (2)$$

where:

$P_2$=air pressure in second air-tight chamber 62

$P_{amb}$=ambient air pressure outside first air-tight chamber 60

$A_{orifice}$=area of adjustable orifice 64

$A_{generator}$=area of the air inlet 16 of projectile ogive 10.

Hence, given a flight Mach number and an altitude to simulate, the required $P_2$ is first determined from equation (1). Pressure $P_1$ is obtained for the particular altitude from atmospheric tables. Equation (2) then allows the determination of the area of orifice 64 to achieve the desired $P_2$. Thus by achieving the desired pressures at the generator air inlet and air outlet, the conditions that establish the mass flow available to the generator in flight is simulated in the laboratory.

For example, to simulate the flight condition for Mach 1.18 at an altitude of 58,900 feet, the required $P_2$ is first determined from equation (1). In this case $P_2$=2.59 psia. Pressure $P_1$ is found from atmospheric tables to be 1.10 psia. With valve 68 fully closed, the chambers are pumped down to the desired static pressure of 1.10 psia. Once this pressure condition is reached valve 68 is opened. Air from the ambient enters through orifice 64 to the second air-tight chamber 62 until the desired $P_2$ is reached. The area of orifice 64 determines the value of $P_2$ in chamber 62.

While the invention has been described with reference to the accompanying drawings, we do not wish to be limited to the details shown therein as obvious modifications may be made by one of ordinary skill in the art.

We claim:

1. An apparatus for causing air flow, comprising:

a. an air driven device having air inlet means and air outlet means;

b. a first air-tight chamber;

c. a second air-tight chamber;

d. means for evacuating said first and second chambers to a preselected pressure;

e. said air inlet means of said air driven device is in fluid communication with said second air-tight chamber;

f. said air outlet means of said air driven device is in fluid communication with said first air-tight chamber;

g. adjustable orifice means; and h. valve controlled air inlet means for allowing air to enter said second air-tight chamber through said adjustable orifice means.

2. The apparatus of claim 1 wherein said air driven device comprises:

a. a projectile ogive; and b. an air driven generator within said projectile ogive.

3. The apparatus of claim 2 wherein said adjustable orifice means forms the union between said second air-tight chamber and said valve controlled air inlet means.

* * * * *